United States Patent [19]

Boyd

[11] Patent Number: 5,001,881

[45] Date of Patent: Mar. 26, 1991

[54] SHEET CLADDED ROOF ASSEMBLY AND CLEAT ARRANGEMENT

[75] Inventor: Thomas J. Boyd, Wellsburg, W. Va.

[73] Assignee: The Louis Berkman Company, Steubenville, Ohio

[21] Appl. No.: 483,665

[22] Filed: Feb. 23, 1990

[51] Int. Cl.[5] ..... E04D 1/34

[52] U.S. Cl. ..... 52/545; 52/573; 52/520

[58] Field of Search ..... 52/544, 545, 547, 549, 52/528, 537, 478, 520, 403, 573

[56] References Cited

U.S. PATENT DOCUMENTS

| | | | |
|---|---|---|---|
| 1,810,287 | 6/1931 | Mahon et al. . | |
| 1,882,105 | 10/1932 | Wender . | |
| 2,250,764 | 7/1941 | Hoess | 52/536 X |
| 3,289,365 | 12/1966 | McLaughlin et al. | 52/521 X |
| 3,353,319 | 11/1967 | Gronlund | 52/520 |
| 3,852,933 | 12/1974 | Guzzo | 52/537 X |
| 3,858,373 | 1/1975 | Day et al. | 52/713 |
| 3,945,166 | 3/1976 | Hosoda et al. | 52/525 X |
| 3,999,348 | 12/1976 | Hicks | 52/545 X |
| 4,034,532 | 1/1977 | Reinwall, Jr. | 52/573 X |
| 4,096,681 | 6/1978 | Netterstedt et al. | 52/713 |
| 4,213,282 | 7/1980 | Heckelsberg | 52/528 X |
| 4,514,952 | 5/1985 | Johannson | 52/528 X |
| 4,570,404 | 2/1986 | Knudson | 52/545 X |

FOREIGN PATENT DOCUMENTS

| | | | |
|---|---|---|---|
| 1266994 | 12/1961 | France | 52/520 |

*Primary Examiner*—John E. Murtagh
*Assistant Examiner*—Creighton Smith
*Attorney, Agent, or Firm*—Body, Vickers & Daniels

[57] ABSTRACT

A sheet steel cladding roof assembly comprised of a series of side-by-side sheet steel roofing panels of shallow U-shaped cross-section and joined together along their adjacent upstanding side walls by folded over standing seam joints is secured to the roof substrate continuously along each of the standing seam joints by a two-part continuously extending cleat arrangement comprising an anchor member fixedly secured to the roof substrate underneath one of the jointed roof panels and a slide member clamped in the standing seam joint and having a longitudinal upstanding sliding lap seam expansion connection with the anchor member permitting longitudinal sliding movement of the slide member and its associated roofing panels relative to the anchor member to accommodate thermal longitudinal expansion and contraction of the elongated jointed roofing panels.

26 Claims, 5 Drawing Sheets

FIG. 1
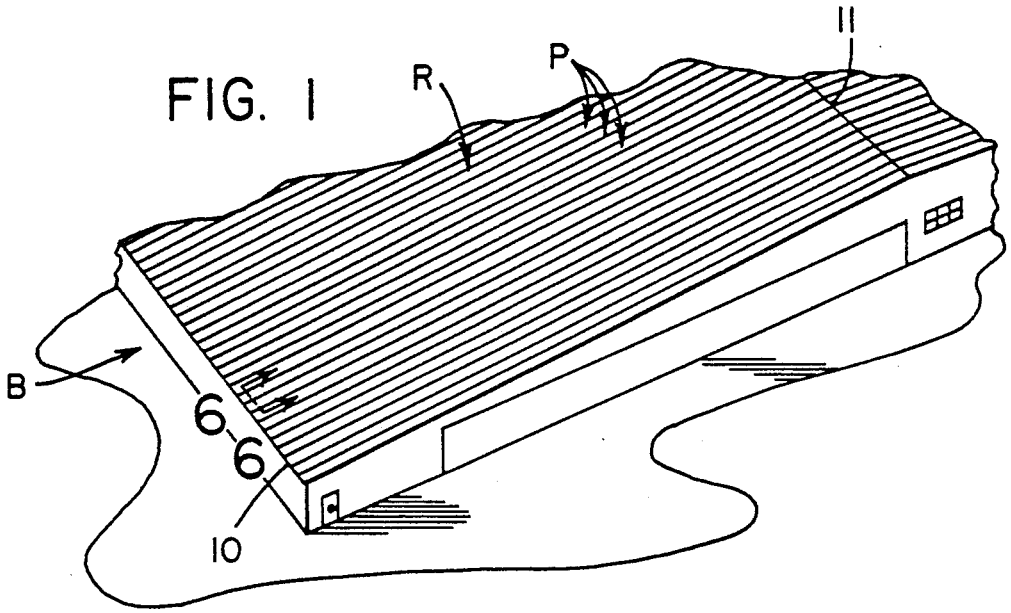
FIG. 2
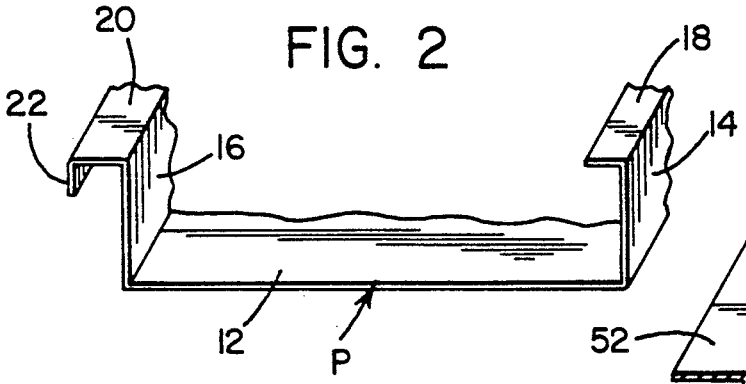
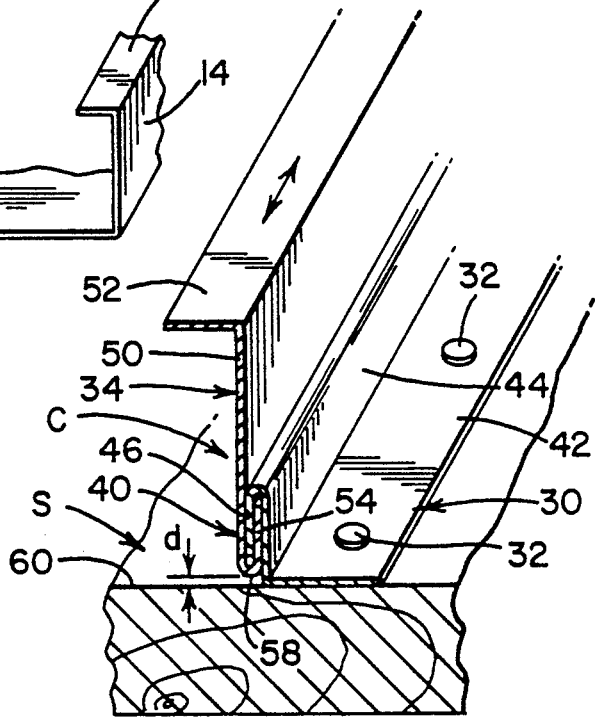
FIG. 4
FIG. 3
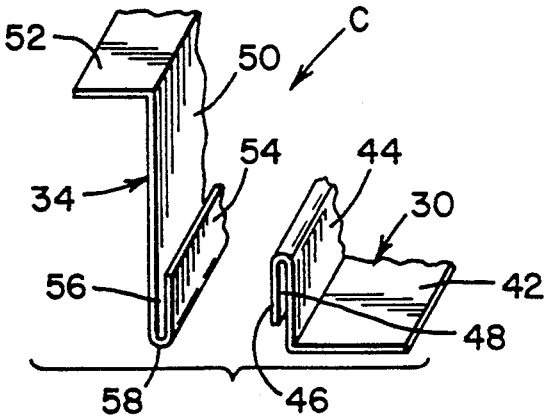

FIG. 8A
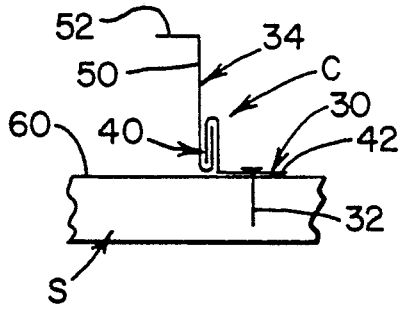
FIG. 8B
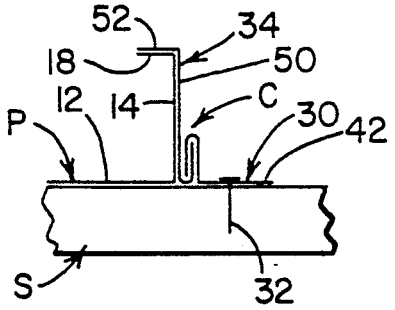
FIG. 8C
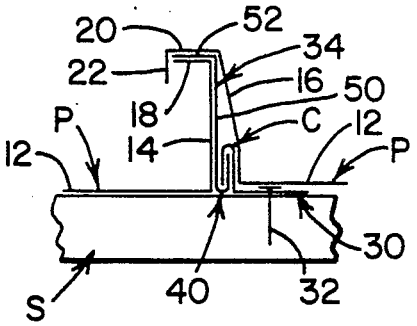
FIG. 8D
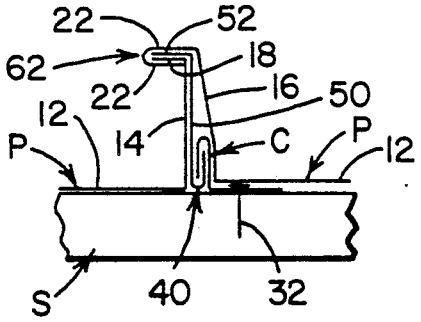
FIG. 8E
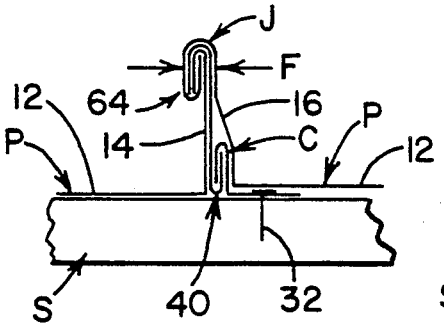
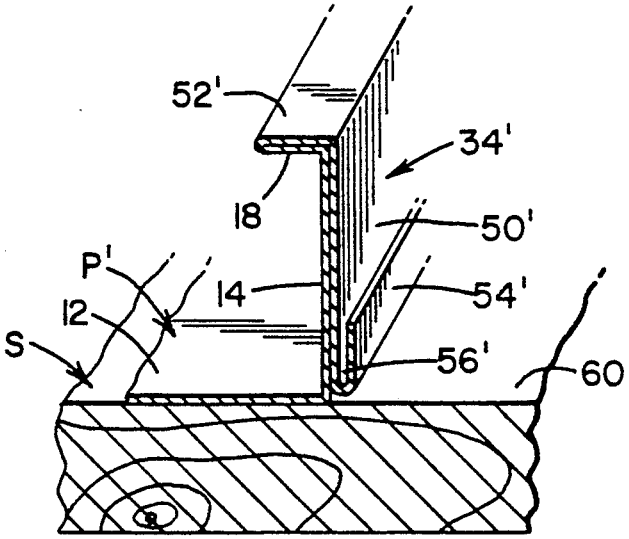
FIG. 10
FIG. 9
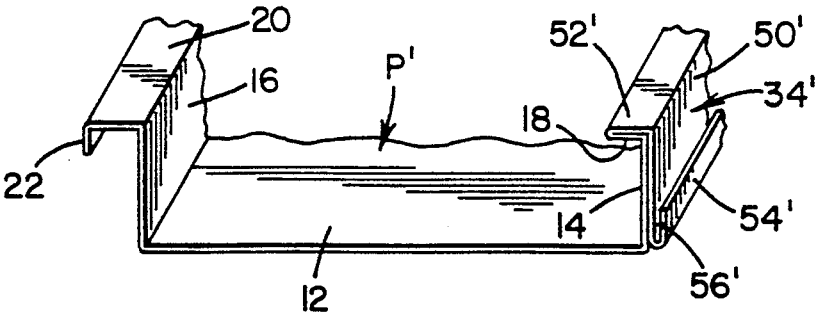

SHEET CLADDED ROOF ASSEMBLY AND CLEAT ARRANGEMENT

This invention relates in general to metal cladding roof assemblies and more particularly to an expansion type cleat arrangement therefor to hold the roof assembly in place on the roof substrate.

BACKGROUND OF THE INVENTION

Sheet metal roofing systems of the type to which this invention relates are customarily formed of a series of elongated sheet metal roofing panels or pans of up to one-hundred feet or so in length mounted on a roof substrate in side-by-side relation and joined together at their adjacent longitudinal side edges by a so called standing seam type water-tight joint. The roofing panels are made of either low carbon steel or stainless steel sheet metal of generally channel-shaped form each comprising a flat base portion provided along its opposite longitudinal side edges with upstanding side edge or wall portions one of which is formed at its top with an inturned horizontal top flange portion and the other one of which is formed at its top with an outturned horizontal top flange portion terminating in a downturned edge flange.

In assembling the roofing panels together onto the roof substrate, they are successively placed side-by-side, with their upstanding side edge wall portions adjacent one another and with the outturned horizontal top or seam forming flange portion of one roofing panel overlying and lying against the inturned horizontal top flange portion of the adjacent roofing panel. The downturned edge portion of the outturned top flange portion of the one roofing panel is then bent or folded inwardly around the underside of the inturned top flange portion of the adjacent other one of the roofing panels to engage thereagainst, and the resulting combined assembly of the inturned flange portion and the outturned flange portion with its inturned edge flange then bent downwardly to a vertical position and pressed together with the adjacent upstanding side wall of the other one of the roofing panels to form a folded standing seam joint between the adjoining roof panels.

To fix the joined together assembly of roofing panels down in place onto the roof substrate, sheet metal cleat members, each comprising a vertically extending web portion provided at its top and bottom edges with horizontally outturned flange portions, is customarily interposed between the adjacent upstanding side wall portions of adjacent roof panels, with the top flange portion clamped in place within the folded standing seam joint and the bottom flange portion underlying one of the roofing panels and suitably fixedly attached to the roof substrate as by fastening nails for instance. The cleat members preferably extend continuously the full length of the roofing panels.

To render the folded standing seam joint water-tight and the roof assembly thus suitable for roofs having little or no slope or pitch, a gasket arrangement is preferably provided within the folded standing seam. The gasket arrangement may be comprised of a suitable gasket material which is applied either to the top flange portion of at least one of the upstanding adjacent side edge wall portions of the adjacent roofing panels or to only the seam forming section of the vertical web portion of the cleat member and which is deformable, when the seam is pressed together in a press fit type manner, to form a water-tight seal within the standing seam joint. The gasket material preferably is the terneplate coating described in Federal Specification QQ-T-201F published Nov. 12, 1986 by the United States Government and comprised of an alloy containing about twenty percent tin and eighty percent lead.

A roof system of the above-described type is disclosed in U.S. patent application Ser. No. 415,554 filed Oct. 2, 1989 and assigned to the assignee of the present application. Because of the fixation of the cleat members of such prior roof cladding assemblies at their bottom flange portions to the roof substrate by fastening nails or the like, the adjacent roofing panels which are joined and longitudinally locked together with the cleat members by their standing seam joints are prevented from freely expanding and contracting longitudinally relative to the roof substrate under the varying ambient temperature or weather conditions, such as ice and snow present on the roof structure, to which they are normally subjected. As a result, the expansion and contraction forces exerted by the seamed together roofing panels on the associated cleat member joined thereto within the folded standing seam are apt to cause, especially in the case of roofing panels of a length in excess of thirty feet, eventual loosening of the attachment of the cleat member to the roof substrate with accompanying loosening of the roof assembly thereon and even possible separation therefrom. Also, buckling of the roofing panels is possible because of the prevention of free longitudinal thermal expansion and contraction movement of the roofing panels on the roof substrate.

SUMMARY OF THE INVENTION

The present invention contemplates a sheet metal roofing assembly generally of the above-described type which overcomes all of the above referred to problems and others and permits the free longitudinal thermal expansion and contraction movement of the seamed together adjacent roofing panels relative to the roof substrate.

Briefly stated, in accordance with a principal aspect of the invention, the cleat means employed in such type sheet metal roof assemblies is comprised of two separate cleat portions or members including an anchor cleat portion fixedly anchored to the roof substrate and a slidable cleat portion fixed in the folded standing seam joint of adjacent roofing panels and having an upright longitudinally extending expansion lap seam connection with the anchor cleat portion permitting relative longitudinal sliding movement between the two cleat portions while preventing upward separation thereof.

In accordance with another aspect of the invention, the two cleat portions are comprised of separate members including an anchor cleat member fixedly anchored to the roof substrate and a slidable cleat member clamped in and united with the folded standing seam between adjacent roofing panels.

In accordance with a further aspect of the invention set forth in an alternative embodiment of the invention, the slidable cleat portion of the two part cleat means is formed as an integral portion of one of the upstanding side edge wall portions of one of the adjacent roofing panels.

It is a principal object of the invention to provide a sheet metal roof assembly of the above referred to folded standing seam type having roofing panels which are free to longitudinally expand and contract on the roof substrate.

Another object of the invention is to provide a sheet metal roof assembly of the above referred to type which will not become unloosened from the underlying roof substrate by longitudinal thermal expansion and contraction of the roofing panels.

Still another object of the invention is to provide a sheet metal roof assembly of the above referred to type having a two part cleat arrangement which is provided with an expansion lap seam connection and which is of simple construction easy to fabricate and assemble with the roofing panels of the roof assembly.

A further object of the invention is to provide a sheet metal roof assembly of the above referred to folded standing seam type having a cleat arrangement which permits free longitudinal expansion and contraction movement of the jointed roofing panels on the roof substrate.

A still further object of the invention is to provide a sheet metal roof assembly of the above referred to folded standing seam type with a cleat arrangement comprised of two component sections jointed by an expansion seam permitting relative sliding movement of the two sections in a direction longitudinally of the associated roofing panels.

Yet another object of the invention is to provide a sheet metal roof assembly of the above referred to standing seam type with a two section continuously extending cleat arrangement comprised of an elongated anchor section anchored to the roof substrate and a cooperating elongated slide section fixed within the standing seam of the associated pair of roofing panels and jointed to the anchor section by an upstanding expansion lap seam permitting longitudinal sliding movement of the slide section relative to the anchor section while restricting upward separation therebetween.

Further objects and advantages of the invention will be apparent from the following description of a preferred embodiment thereof and from the accompanying drawings.

BRIEF DESCRIPTION OF THE DRAWINGS

In the drawings:

FIG. 1 is a pictorial view of a building provided with a sheet metal roof assembly including a cleat arrangement in accordance with the present invention;

FIG. 2 is a fragmentary perspective view of one of the roofing panels of the roof assembly shown in FIG. 1;

FIG. 3 is a fragmentary exploded perspective view of the cleat arrangement according to the invention for the roof assembly;

FIG. 4 is a fragmentary cross-sectional perspective view of the cleat arrangement according to the invention shown mounted in place on the roof substrate of the building;

FIGS. 8A through 8E are schematic illustrations of the steps performed in forming a roof assembly according to the invention;

FIG. 9 is a fragmentary perspective view of a modified form of roofing panel integrally formed with one of the members of the cleat arrangement according to the invention;

FIG. 10 is a fragmentary cross-sectional perspective view showing the modified form of roofing panel of FIG. 9 positioned in place on a roof substrate for lap seam engagement with an anchor cleat portion to be anchored thereto;

DESCRIPTION OF THE PREFERRED EMBODIMENTS

Figure 6:
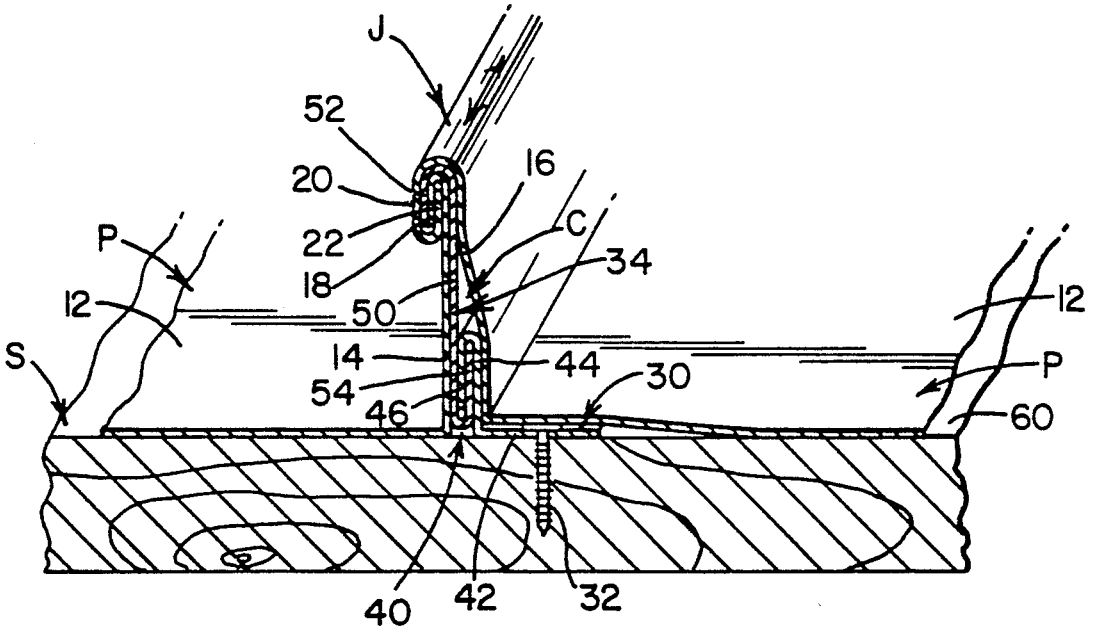
FIG. 6 is a view similar to FIG. 5 showing the completed standing seam joint between the adjacent roofing panels of the final roof assembly according to the invention.

Referring now to the drawings wherein the showings are for the purposes of illustrating preferred embodiments of the invention only and not for the purpose of limiting the invention, in FIG. 1 there is shown a building B provided with a sheet metal cladding type roof assembly R according to the invention mounted on and covering a conventional wooden roof substrate 5 (FIG. 6). The roof assembly R is comprised of a series of elongated sheet metal roofing panels or pans P mounted in side-by-side adjacent relation on the roof substrate S and extending from the eave 10 of the roof to the ridge 11 thereof, and secured together along their adjacent side edges by an elongated standing seam joint J (FIG. 6).

As best shown in FIG. 2, the roofing panels P are preferably preformed in the shape of elongated pans. Preformed pans are commercially available from suppliers such as Follansbee Steel Company of Follansbee, W. Va., a division of the assignee of the present invention. Such preformed pans or panels P are typically furnished in lengths of up to about twenty feet. Alternatively, as for larger lengths, panels P of essentially the same cross-sectional shape as the preformed pans, may be formed at the building construction site from a roll of sheet metal stock by a pan forming machine. For purposes of this specification, the term panels P means either preformed pans or pans formed by a pan forming machine.

Panels P may be formed from any suitable sheet metal of standard gauge thickness typically used in the metal roofing industry. For the purposes of the invention, the sheet metal employed for the panels P may be either plain carbon steel or bare stainless steel. However, in the preferred embodiment of the invention, a terne plate coated stainless steel of sheet metal gauge is employed. Terne coated stainless steel is a commercially available product as described in the above referred to Federal Specification QQ-T-201F, the coating consisting of a composition of about 20% tin and 80% lead and having a relatively heavy thickness, i.e., from about 0.35 mm to about 0.45 mm. The terne coating has the characteristic of becoming plasticized or deformed under pressure and, when deformed, the coating can function as a gasket for sealing a joint.

A typical roofing panel P employed for the roof assembly R according to the invention is shown in FIG. 2 as being in the form of an elongated, channel-shaped, sheet metal pan preferably of terne coated stainless steel sheet of about 0.015 to 0.018 inches thickness, and comprised of a base or web portion 12 formed along its opposite side edges with upstanding side edge or wall portions 14 and 16 of approximately equal height. The wall portions 14, 16 are provided along their top edges with respective horizontally extending side edge or lateral flanges 18 and 20 of approximately equal width. Flange 18 is inturned while flange 20 is outturned and is provided along its outer edge with a depending seam flange 22 spaced from the wall portion 16 a distance slightly greater than the width of the inturned flange 18 so as to receive therebetween the inturned flange 18 of an adjacent panel P during the fabrication of the roof assembly R. For ease of assembly, the preformed panels have a base portion 12 width at one axial end thereof which is slightly less than that at the other axial end, i.e., around 1/16" less width.

Figure 5:
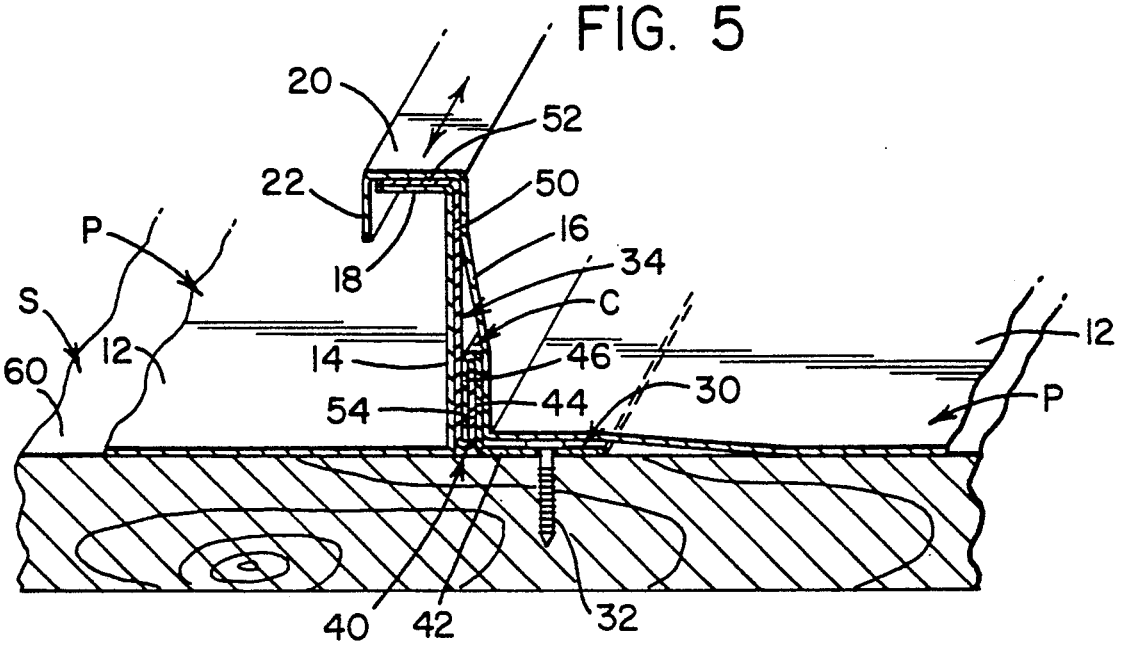
FIG. 5 is a fragmentary cross-sectional perspective view showing adjacent roofing panels assembled in place together with the cleat arrangement on the roof substrate, in position for forming the standing seam joint between the roofing panels.

In the formation of the roof assembly R on the roof substrate S, an adjacent pair of roofing panels P are positioned side-by-side on the roof substrate with their upstanding wall portions 14 and 16 placed alongside one another and with the outturned side edge lateral flange 20 of the one panel overlying the inturned side edge lateral flange 18 of the adjacent other panel and the depending seam flange 22 extending downwardly alongside the outer edge of the inturned lateral flange 18 (FIG. 5). The depending flange 22 on the outturned lateral flange 20 of the one panel P is thus in position to be bent inwardly under and folded tightly around and against the underside of the inturned side edge lateral flange 18 of the other adjacent panel and the resulting folded assembly then bent downwardly and pressed against the upstanding side edge wall 14 of the other one panel P, as shown in FIG. 6, in the eventual formation of the folded standing seam joint J between the two adjacent panels connecting them together in a watertight seal.

Figure 7:
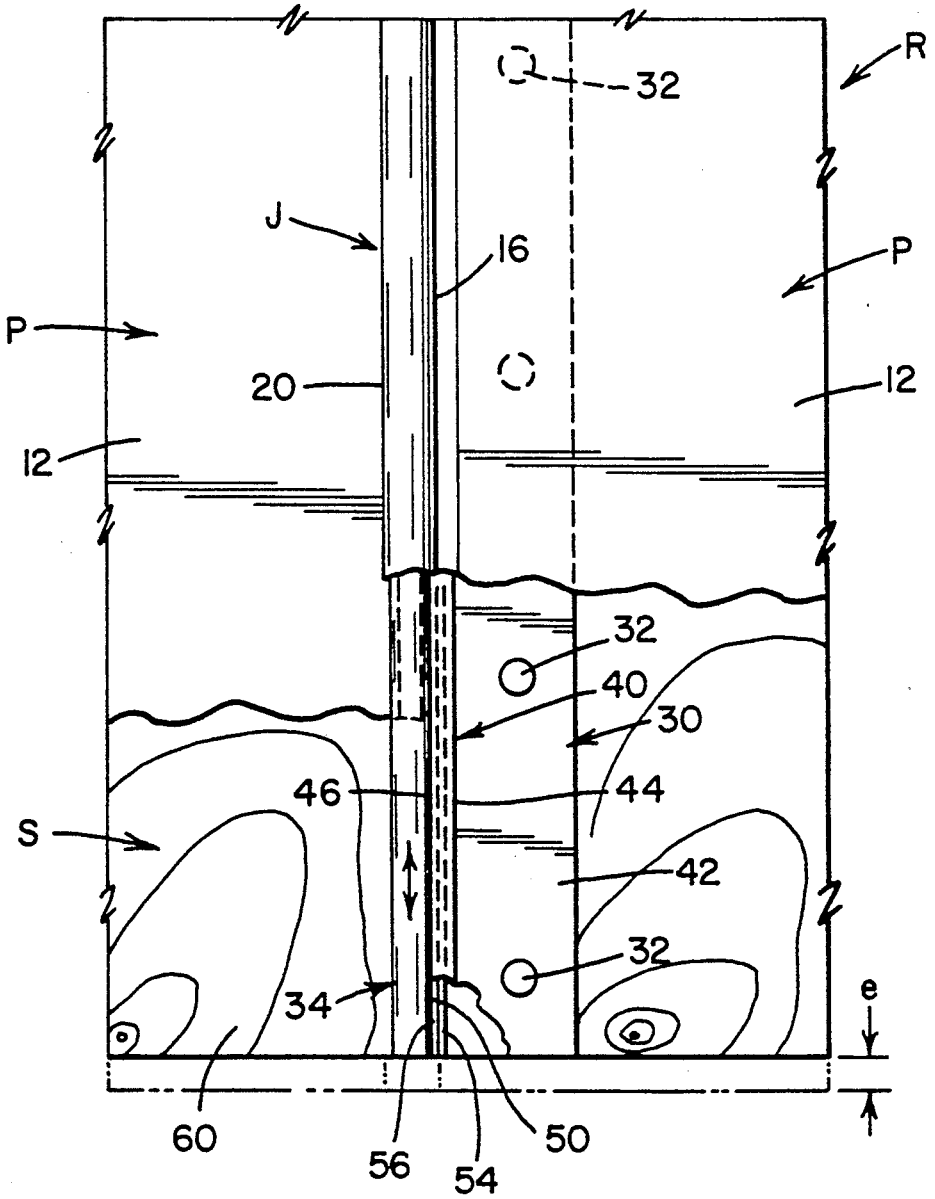
FIG. 7 is a partial plan view of the final roof assembly with elements thereof shown partially broken away.

As shown in FIG. 6, cleat means C are provided for fastening the roofing panels P at their standing seam joints J down onto the roof substrate S to prevent separation of the roof assembly R therefrom as by windstorms. The cleat means extends continuously throughout the full length of the adjacent panels and is comprised of a lower anchor portion or member 30 fixedly secured to the roof substrate S as by fastening nails or screws 32 anchored in the substrate, and a seam united portion 34 clamped and fixed in the standing seam joint J between adjacent panels P. In accordance with the invention, the cleat portions 30 and 34 of such type cleat means C, instead of being formed by a single member as with prior type such seam unite cleat means, is formed of two separate parts or members 30 and 34 which are slidably connected together, in the space between the upstanding side edge wall portions 14 and 16 of the adjacent panels P, by a continuously extending, upstanding, expansion or sliding lap seam interconnection 40 (FIG. 4) which vertically locks the cleat portions 30 and 34 together against upward separation while permitting the seam united portion or member 34 to slide longitudinally relative to the anchored portion or member 30 under longitudinal thermal expansion and contraction movement of the adjacent panels P as indicated by the distance e in FIG. 7.

As shown particularly in FIGS. 3 and 4, the elongated anchor portion or member 30 and the seam united portion or member 34 of the cleat means C are both formed of terne coated sheet steel of comparable gauge to that of the panels P. Anchor member 30 is bent into right angle cross-sectional shape to form a horizontally extending base or anchor leg portion 42 provided with a plurality of apertures (not shown) at spaced points therealong for insertion of the fasteners 32 therethrough, and an upstanding connector leg or flange portion 44 which is doubled back upon itself to form a downwardly extending flange 46 parallel to the connector leg portion 44 and forming therewith a downwardly opening narrow slot or hook channelway 48 of a width slightly greater, e.g., less than around 0.5 mm greater, than the thickness of the sheet steel employed for the cleat members 30, 34.

The seam united cleat portion 34 of the cleat means C is comprised of a vertically extending web portion 50 which is provided along its top edge with an outturned seam uniting or lateral top flange 52 and is doubled back upon itself along its bottom end to form an upwardly extending flange 54 parallel to the web portion 50 and forming therewith an upwardly opening narrow slot or hook channelway 56 of a width the same as the slot 48 of anchor member 30. The flanges 46 and 54 of the anchor and the seam united cleat members 30 and 34 are adapted to snugly interfit within the slots or channelways 56 and 48 thereof for free longitudinal sliding movement therein to form the longitudinal expansion lap seam connection 40 therebetween which locks the cleat members 30, 34 together against vertical separation.

In the mounted position of the cleat members 30 and 34 on the roof substrate S, the interfitted flange portions 46 and 54 thereof should overlap one another a sufficient distance substantially greater, e.g., at least around three times greater than the clearance distance d (FIG. 4) between the lower bight edge 58 of cleat member 34 and the top surface 60 of the roof substrate S, to assure against the interfitted flange portions 46 and 54 of the roof assembly ever becoming disengaged from one another and the roof panels so becoming separated from the roof substrate S at their jointed together sides.

Referring now to FIGS. 8A–8E, in fabricating the roof assembly R according to the invention, the two cleat members 30 and 34 of cleat means C are first joined together by their interfitting sliding lap seam joint 40 and then fixedly secured in place on the roof substrate S by fastening nails or screws 32 inserted through apertures in the anchor leg portion 42 of cleat member 30, as shown in FIG. 8A. The interfitted assembly of cleat members 30, 34 is fixedly secured to the roof substrate S with the web portion 50 of cleat member 34 upstanding and abutted flatwise against the side edge wall portion 14 of a first roofing panel P previously affixed to the roof substrate (FIG. 8B), and with the inturned side edge flange 18 of the panel P extending alongside and underneath the lateral top flange 52 of cleat member 34. A second roofing panel P to be jointed to the first panel P is then placed in rested position on the roof substrate S with its upstanding side edge wall portion 16 extending alongside the web portion 50 of cleat member 34 and with the outturned side edge flange 20 of the second panel P overlying and resting against the outturned top or seam forming flange 52 of cleat member 34, and with the downturned flange 22 of the second panel P extending downwardly alongside the outward edges of the respective horizontally layered flanges 18 and 52 of the first panel P and cleat member 34, as shown in FIG. 8C which corresponds to FIG. 5.

With the cleat means C and the second roofing panel P thus positioned in place relative to the first roofing panel P and cleat member 34, a conventional seaming machine is then employed to fold the downturned flange 22 of the second panel P inwardly underneath the layered subassembly of the flanges 18, 20 and 52 and in engagement with the underside of flange 18 to form the layered assembly 62 of all these flanges, as shown in FIG. 8D, and to then bend this layered flange assembly 62 vertically downward against the upstanding side edge wall portion 14 of the first panel P as shown in FIG. 8E, to thereby form the folded final assembly 64 consisting of 7 thicknesses or plies of sheet metal which comprise the standing seam joint J.

To complete the formation of the standing seam joint J and render it water-tight, a strong compressive pressure force F is then applied by suitable compressing apparatus to the folded layered assembly 64, as shown in FIG. 8E, to form the final folded standing seam joint J in the nature of a press fit assembly. During the compression of the assembly 64, the terne coating of lead-tin composition on the roof panels P and/or the cleat member 34 is plasticized and deformed to form a sealant which effectively seals the joint J to render it water-tight. Preferably, the folded standing seam joint J has a vertical dimension of around ½ inch.

After completion of the standing seam joint J between the first and second roofing panels P, additional panels P are then joined to the second panel and together in the same manner as described above in connection with FIGS. 8A–8E until the entire roof substrate is fully covered by the sheet steel cladding roof assembly R.

The sliding lap seam joint 40 between the cleat members 30 and 34 of each adjacent pair of standing seam jointed roof panels P permits these panels to thermally expand and contract longitudinally throughout the distance e (FIG. 7) relative to the anchored cleat member 30 and to the roof substrate S, as indicated by the oppositely directed arrows in FIGS. 4–7, while still holding the roof assembly secured in place down onto the roof substrate against separation therefrom. Moreover, the cleat portions 30 and 34 of the cleat means C are of simple and easily formed shape such as requires a minimum of forming operations, and they are easily assembled and mounted in place on the roof substrate S in their sliding lap seam jointed manner 40 according to the invention.

Figure 11:
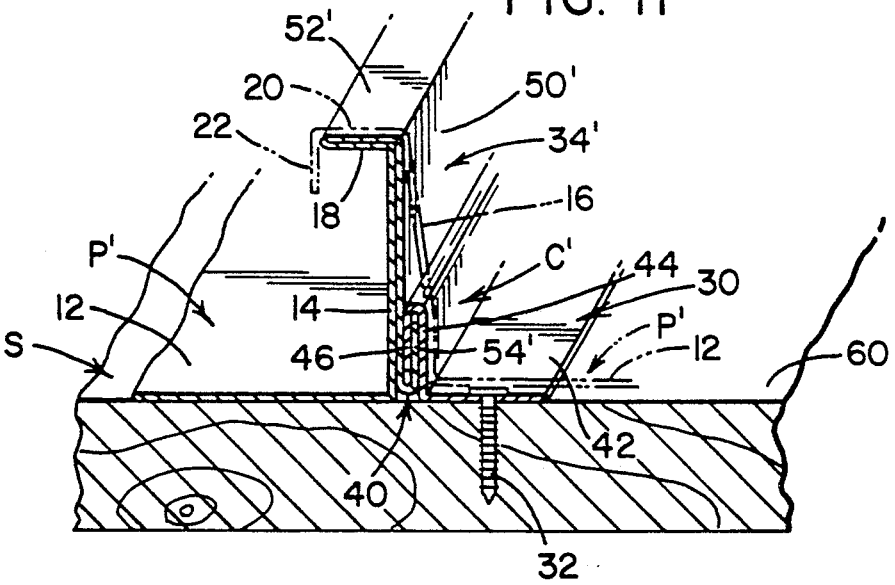
FIG. 11 is a view similar to FIG. 5 showing the modified roofing panel of FIGS. 9 and 10 joined by an upstanding expansion lap seam to the anchor cleat portion of the cleat arrangement according to the invention; and, FIGS. 12A through 12E are schematic illustrations of the steps performed in forming a roof assembly with the modified form of roofing panels shown in FIGS. 9 and 10.

In the modification shown in FIGS. 10–12, the slidable portion 34 of the cleat means C, rather than being formed as a separate member, instead is formed as an integral portion 34' of the respective roofing panels P'. Specifically, the slidable cleat portion 34' of the modified cleat means C' is formed as an integral extension of the upstanding side edge wall portion 14 of the respective roofing panels P', and is comprised of a seam uniting flange portion 52' formed by a double-back overlying extension of the inturned flange 18 on the roofing panel, a web portion 50' extending vertically downward from the flange portion 52' alongside and engaged flatwise against the side edge wall portion 14 of the roof panel, and a double-back upturned flange portion 54' of the web portion 50' formed along its bottom end and extending parallel to the web portion 50' to form therewith an upwardly opening narrow slot or hook channelway 56' corresponding to the hook channelway 56 of the cleat means C shown in FIG. 3. As with the first embodiment of the invention described hereinabove, the doubled-back flanges 46 and 54' of the anchor cleat member 30 and the slidable cleat portion 34' of the associated roofing panel P' are adapted for sliding interfitted relation within the respective slot-shaped channelways 56' and 48 of the cleat portion 34' and anchor cleat member 30 for free longitudinal sliding movement therein to form the longitudinal expansion and contraction lap seam connection 40 between the anchor cleat member 30 and the slidable cleat portion 34' of the cleat arrangement C'.

Figure 12A:
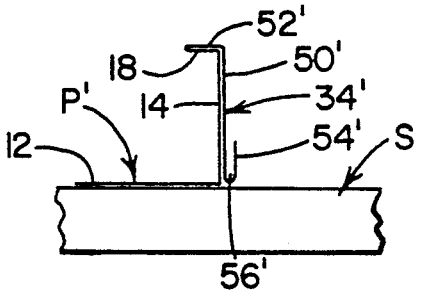
Figure 12B:
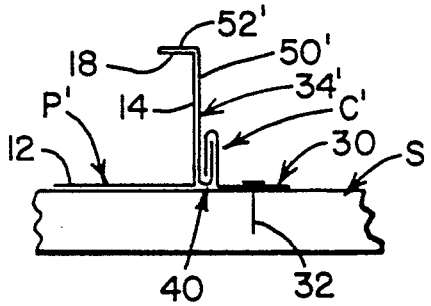
Figure 12C:
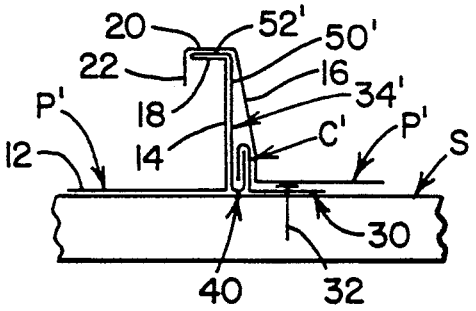

Referring to FIGS. 12A–12E, in fabricating a roof assembly R according to the invention using the modified cleat means C' of FIGS. 9–11, a cleat member 30 is fixedly secured, as by nails or arrows 32, to the roof substrate S in interfitted sliding lap seam engagement as shown at 40 in FIG. 12B with the cleat portion 34' of a modified first roofing panel P' which has been previously fastened in place onto the roof substrate S as shown in FIG. 12A. A second modified roofing panel P' is then positioned in place on the roof substrate S in longitudinal alignment with the first panel P', with its side edge wall portion 16 extending alongside the web portion 50' of cleat portion 34' and with the outturned flange 20 of the second roofing panel P' overlying and resting against the seam uniting flange portion 52' of cleat portion 34' and with the depending seam flange 22 of the second roofing panel overlapping the outer edges of the doubled-back flanges 18 and 52' of the first roofing panel P', all as shown in FIG. 12C.

Figure 12D:
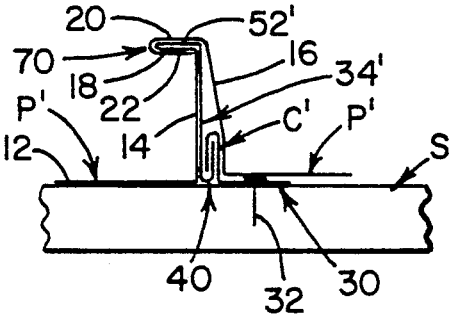
Figure 12E:
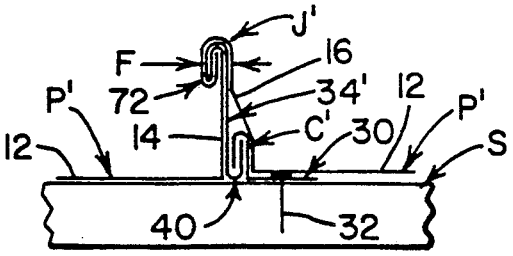

With the first and second roofing panels P' thus positioned in place relative to each other and to the slidable cleat portion 34' of the cleat means C', a conventional seaming machine then folds the downturned flange 22 of the second panel P' inwardly underneath the layered subassembly of the flanges 18, 20 and 52' and in engagement with the underside of flange 18 to form the layered assembly 70 of all these flanges, as shown in FIG. 12D, and to then bend this layered flange assembly 70 vertically downward against the upstanding side edge wall portion 14 of the first roofing panel P', as shown in FIG. 12E, to thereby form the folded final assembly 72 consisting of 7 thicknesses or plies of sheet metal which comprise the folded standing seam joint J'. As before, to complete the formation of the standing seam joint J' and render it water-tight, a strong compressive force F is then applied by suitable compressing apparatus to the layered assembly 72, as shown in FIG. 12E, to form the final folded standing seam joint J' in the nature of a press fit assembly. As before, during this compressing of the layered assembly 72 the terne coating of lead-tin composition on the roof panels P' and/or the cleat portion 34' of the cleat means C' is plasticized and deformed to form a sealant which serves to effectively seal the joint J' and render it water-tight.

While the invention has been described above with reference to preferred embodiments of the invention, obviously modifications and alterations will occur to others upon the reading and understanding of this specification. Thus, rather than forming the sliding lap seam joint 40 between the cleat members 30 and 34 in the preferred manner to extend continuously throughout the full longitudinal extent thereof, the lap seam joint 40 may be formed by a series of interfitted hook-shaped portions 46 and 54 on the respective cleat portions 30 and 34 spaced apart longitudinally thereof. It is my intention to include all such modifications and alterations insofar as they come within the scope of the appended claims or the equivalents thereof.

Having thus described the invention, it is claimed:

1. A sheet metal roof assembly comprising a series of elongated channel-shaped sheet metal roofing panels mounted in side-by-side relation on a roof substrate and having upstanding side edge wall portions, adjacent said side edge wall portions of adjacent ones of said panels being joined by folded standing seam joints, and cleat means disposed between and extending continuously along the full length of the said upstanding side edge wall portions of adjacent ones of said roofing panels and anchoring said joined panels to the roof substrate, said cleat means each comprised of two separate sheet metal portions including an elongated anchor member fixedly fastened to the roof substrate and an elongated slide portion fixed in the said standing seam of the respective adjacent panels and having an upright longitudinally extending continuous expansion seam connection vertically locking said slide portion with said anchor member against upward separation therefrom while permitting sliding movement of said slide portion relative thereto, said elongated anchor member and said slide portion of said cleat means and the said expansion seam connection therebetween extending throughout the full length of said roofing panels.

2. A roof assembly as defined in claim 1, wherein the said slide portion and anchor portion of said cleat means are respectively formed with upwardly and downwardly opening narrow U-shaped hook portions slidably interfitted within one another to form an upright expansion lap seam connection between the said cleat portions.

3. A roof assembly as defined in claim 1, wherein the said slide portion of said cleat means comprises a separate member from the respective said roofing panels.

4. A roof assembly as defined in claim 2, wherein the said slide portion of said cleat means is formed as an integral part of the respective said roofing panels.

5. A roof assembly as defined in claim 2, wherein the said slide portion of said cleat means comprises a separate member from the respective said roofing panels.

6. A roof assembly as defined in claim 1, wherein the said expansion seam connection of said cleat slide portion to said cleat anchor member is located adjacent the bottom regions of the said upstanding side edge wall portions of said adjacent roofing panels.

7. A roof assembly as defined in claim 1, wherein the said anchor cleat member has a horizontal anchor leg portion underlying a respective one of said roofing panels and secured to said roof substrate by fasteners anchored therein.

8. A roof assembly as defined in claim 1, and including a deformable gasket coating provided on at least one of said side edge wall portions and deformed in said folded standing seam joint between adjacent said roofing panels to seal the said seam.

9. A roof assembly as defined in claim 2, wherein the said elongated anchor member of said cleat means is of L-shape cross-section having an anchor leg portion underlying one of said joined roofing panels and fixedly fastened flatwise to the said roof substrate and an upstanding connector leg portion extending between the said adjacent upstanding side edge wall portions of said roofing panels and doubled back to form said downwardly opening U-shaped hook portion, and said slide portion of said cleat means having a web portion extending vertically between the said adjacent side edge wall portions of said roofing panels and provided at its upper end with a lateral flange clamped within the said standing seam joint of said adjacent roofing panels, said web portion of said slide portion being doubled back at its lower end to form said upwardly opening U-shaped hook portion slidably interfitted within the said downwardly opening U-shaped hook portion of said anchor member.

10. In a sheet metal roof assembly including a plurality of elongate roofing panels extending side-by-side on a roof substrate and each comprised of a base portion having upstanding longitudinally extending side edge wall portions respectively formed with longitudinally extending lateral side edge flanges, said panels positioned adjacent one another with a side edge wall portion of one panel extending alongside the side edge wall portion of another panel and the said side edge flange of said one panel being bent under and folded tightly around the said side edge flange of the said other panel and bent vertically downward therewith to form a folded standing seam joint, and cleat means anchoring said jointed roofing panels to the roof substrate, the improvement comprising:

said cleat means comprised of two sheet metal cleat portions disposed between the said upstanding side edge wall portions of said adjacent positioned panels and extending continuously therealong, one of said cleat portions comprising an anchor cleat member having a horizontal flange portion underlying the base portion of one of said roofing panels and fixedly secured to said roof substrate and the other one of said cleat portions having a horizontal seal flange portion securely clamped within the said seam joint between the said tightly bent and folded together side edge flanges of said adjacent panels, said cleat portions having vertically extending portions slideably fitted together between the said upstanding side edge portions of said adjacent panels by a vertically extending lap seam expansion joint for permitting relative longitudinal sliding movement joint for permitting relative longitudinal sliding movement between said cleat portions under longitudinal expansion and contraction of said jointed adjacent panels while preventing upward separation of said other one of said cleat portions from the said anchor cleat member, said slideably fitted together portions of said cleat portions forming the said lap seam expansion joint extending continuously throughout the full length of said roofing panels.

11. The improvement as defined in claim 10, wherein the said vertically extending portions of said cleat portions are respectively formed with upwardly and downwardly opening narrow U-shaped hook portions slidably interfitted within one another to form the said lap seam expansion joint.

12. The improvement as defined in claim 10, wherein the said other one of said cleat portions constitutes an integral portion of the said other one of said panels.

13. The improvement as defined in claim 10, wherein the said other one of said cleat portions constitutes a separate member from said other one of said panels.

14. The improvement as defined in claim 11, wherein the said other one of said cleat portions constitutes an integral portion of the said other one of said panels.

15. The improvement as defined in claim 11, wherein the said other one of said cleat portions constitutes a separate member from said other one of said panels.

16. The improvement as defined in claim 10, wherein the said slidably fitted together portions of said cleat portions forming the said lap seam expansion joint extend continuously throughout the full length of said roofing panels.

17. The improvement as defined in claim 10, wherein the slidably fitted together portions of said cleat portions forming the said lap seam expansion joint are located adjacent the bottom regions of the said upstanding side edge wall portions of said adjacent panels.

18. The improvement as defined in claim 11, wherein the said slidably interfitted hook portions of said cleat portions forming the said lap seam expansion joint are located adjacent the bottom regions of the said upstanding side edge wall portions of said adjacent panels.

19. The improvement as defined in claim 10, wherein the said anchor one of said cleat portions is secured to said roof substrate by fastening nails anchored therein.

20. The improvement as defined in claim 11, wherein the said anchor one of said cleat portions is secured to said roof substrate by fastening nails anchored therein.

21. A roof assembly as defined in claim 10, and including a deformable gasket coating provided on at least one of said side edge flanges and deformed in said standing seam joint to seal the same.

22. A roof assembly as defined in claim 11, and including a deformable gasket coating provided on at least one of said side edge flanges and deformed in said standing seam joint to seal the same.

23. A sheet metal roof assembly comprising a series of elongated channel-shaped sheet metal roofing panels mounted in side-by-side relation on a roof substrate and having upstanding side edge wall portions, adjacent said side edge wall portions of adjacent ones of said panels being joined by folded standing seam joints, and cleat means disposed between and extending continuously along the full length of the said upstanding side edge wall portions of adjacent ones of said roofing panels and anchoring said joined panels to the roof substrate, said cleat means each comprised of two separate sheet metal portions including an elongated anchor member fixedly fastened to the roof substrate and an elongated slide portion fixed in the said standing seam of the respective adjacent panels and having an upright longitudinally extending continuous expansion seam connection vertically locking said slide portion with said anchor member against upward separation therefrom while permitting sliding movement of said slide portion relative thereto, said elongated slide portion of said cleat means being formed as an integral part of the respective said roofing panels.

24. A roof assembly as defined in claim 23, wherein the said elongated anchor member and said slide portion of said cleat means and the said expansion seam connection therebetween extend throughout the full length of said roofing panels.

25. In a sheet metal roof assembly including a plurality of elongated roofing panels extending side-by-side on a roof substrate and each comprised of a base portion having upstanding longitudinally extending side edge wall portions respectively formed with longitudinally extending lateral side edge flanges, said panels positioned adjacent one another with a side edge wall portion of one panel extending alongside the side edge wall portion of another panel and the said side edge flange of said one panel being bent under and folded tightly around the said side edge flange of the said other panel and bent vertically downward therewith to form a folded standing seam joint, and cleat means anchoring said jointed roofing panels to the roof substrate, the improvement comprising:

said cleat means comprised of two sheet metal cleat portions disposed between the said upstanding side edge wall portions of said adjacent positioned panels and extending continuously therealong, one of said cleat portions comprising an anchor cleat member having a horizontal flange portion underlying the base portion of one of said roofing panels and fixedly secured to said roof substrate and the other one of said cleat portions having a horizontal seal flange portion securely clamped within the said seam joint between the said tightly bent and folded together side edge flanges of said adjacent panels, said other one of said cleat portions constituting an integral portion of the said other one of said panels, said cleat portions having vertically extending portions slideably fitted together between the said upstanding side edge portions of said adjacent panels by a vertically extending lap seam expansion joint for permitting relative longitudinal sliding movement between said cleat portions under longitudinal expansion and contraction of said jointed adjacent panels while preventing upward separation of said other one of said cleat portions from the said anchor cleat member.

26. The improvement as defined in claim 25, wherein the said slideably fitted together portions of said cleat portions forming the said lap seam expansion joint extend continuously throughout the full length of said roofing panels.

* * * * *